US008409318B2

(12) United States Patent
Thyssen et al.

(10) Patent No.: US 8,409,318 B2
(45) Date of Patent: Apr. 2, 2013

(54) PROCESS AND APPARATUS FOR FORMING WIRE FROM POWDER MATERIALS

(75) Inventors: Jeffrey Reid Thyssen, Salem, MA (US); Laurent Cretegny, Niskayuna, NY (US); Daniel Joseph Lewis, Delmar, NY (US); Stephen Francis Rutkowski, Duanesburg, NY (US)

(73) Assignee: General Electric Company, Niskayuna, NY (US)

( * ) Notice: Subject to any disclaimer, the term of this patent is extended or adjusted under 35 U.S.C. 154(b) by 974 days.

(21) Appl. No.: 11/611,326

(22) Filed: Dec. 15, 2006

(65) Prior Publication Data

US 2008/0141825 A1 Jun. 19, 2008

(51) Int. Cl.

| | |
|---|---|
| ***C21B 11/10*** | (2006.01) |
| ***C21B 13/12*** | (2006.01) |
| ***C21C 5/52*** | (2006.01) |
| ***C21C 5/54*** | (2006.01) |
| ***C22B 4/00*** | (2006.01) |

(52) U.S. Cl. ..... 75/10.1; 419/7

(58) Field of Classification Search ..... 419/36, 419/7; 75/10.1

See application file for complete search history.

(56) References Cited

U.S. PATENT DOCUMENTS

| | | | |
|---|---|---|---|
| 5,321,223 | A | 6/1994 | Kimrey, Jr. et al. |
| 5,397,530 | A | 3/1995 | Narasimhan et al. |
| 5,736,092 | A | 4/1998 | Apte et al. |
| 5,740,941 | A | 4/1998 | Lemelson et al. |
| 5,808,282 | A | 9/1998 | Apte et al. |
| 6,004,505 | A | 12/1999 | Roy et al. |
| 6,063,333 | A | 5/2000 | Dennis |
| 6,155,331 | A | 12/2000 | Langer et al. |
| 6,165,616 | A | 12/2000 | Lemelson et al. |
| 6,172,346 | B1 | 1/2001 | Wroe |
| 6,183,689 | B1 | 2/2001 | Roy et al. |
| 6,293,986 | B1 | 9/2001 | Rodiger et al. |
| 6,512,216 | B2 | 1/2003 | Gedevanishvili et al. |
| 6,610,241 | B2 | 8/2003 | Shrout et al. |
| 6,805,835 | B2 | 10/2004 | Roy et al. |
| 6,870,124 | B2 | 3/2005 | Kumar et al. |
| 2002/0106611 | A1 | 8/2002 | Bhaduri et al. |
| 2006/0071053 | A1 | 4/2006 | Garimella |
| 2006/0251536 | A1 * | 11/2006 | Kelly ..... 419/36 |

FOREIGN PATENT DOCUMENTS

| | | |
|---|---|---|
| EP | 0456481 | 5/1991 |
| EP | 1642666 | 5/2006 |
| WO | WO2004073037 | 8/2004 |

* cited by examiner

*Primary Examiner* — Weiping Zhu
(74) *Attorney, Agent, or Firm* — Penny A. Clarke

(57) ABSTRACT

A process and apparatus for forming wires, such as wires used as feedstock in welding, brazing, and coating deposition processes. The process and apparatus generally entail feeding through a passage a quantity of powder particles of a size and composition that render the particles susceptible to microwave radiation. As the particles travel through the passage, the particles within the passage are subjected to microwave radiation so that the particles couple with the microwave radiation and are sufficiently heated to melt at least a radially outermost quantity of particles within the passage. The particles are then cooled so that the radially outermost quantity of particles solidifies to yield a wire having a consolidated outermost region surrounding an interior region of the wire.

18 Claims, 2 Drawing Sheets

PROCESS AND APPARATUS FOR FORMING WIRE FROM POWDER MATERIALS

BACKGROUND OF THE INVENTION

This invention generally relates to processes and equipment for producing wire, such as wire for use as feedstock in welding and coating deposition processes. More particularly, this invention relates to a process and apparatus for forming wire through the application of microwave energy on a powder.

Conventional uses for wires (including rods and filaments) include structural uses such as bearing mechanical loads, electrical uses for carrying electrical currents and telecommunications signals, and as feedstock for a variety of processes. Examples of feedstock usage include certain thermal spray processes such as wire arc spray, certain welding processes such as gas tungsten arc welding (GTAW), plasma arc welding (PAW), and laser beam welding (LBW), and certain physical vapor deposition (PVD) processes. Common processes for producing wires include drawing, rolling, extrusion, sintering powders, and bonding powders together with a binder. The wires may have a homogeneous construction and composition, or may comprise a sheath surrounding a core that may be in the form of a solid bulk, loose or sintered powders, or strands formed of a material that may be the same or different from the sheath material. For example, shielded metal arc welding (SMAW) processes employ a solid metal wire encapsulated in a non-metallic sheath formed of a flux material that forms a protective slag over the molten weld puddle during the welding operation. Wires comprising a powder enclosed in a sheath have been fabricated by rolling, drawing, and extrusion processes, such as by placing a powder in a continuous metallic strip and then closing the strip around the powder in a manner that forms a continuous consolidated sheath.

While the above wire production methods have been successfully employed for many years, there is an ongoing need for methods that are simpler, require less extensive equipment, and capable of producing wires that are difficult to fabricate by conventional methods.

BRIEF SUMMARY OF THE INVENTION

The present invention generally provides a process for forming wires, such as wires used as feedstock in welding and coating deposition processes, and involves the use of microwave energy to form wires by consolidating powder materials.

The process generally entails feeding through a passage a quantity of powder particles of a size and composition that render the particles susceptible to microwave radiation. As the particles travel through the passage, the particles within the passage are subjected to microwave radiation so that the particles couple with the microwave radiation and are sufficiently heated to melt at least a radially outermost quantity of particles within the passage. The particles are then cooled so that the radially outermost quantity of particles solidifies to yield a wire comprising a consolidated outermost region surrounding an interior region of the wire.

As a result of being subjected to the microwave radiation, the radially outermost quantity of particles may be fully molten, while particles within the interior region may or may not. For example, particles located radially inward from the radially outermost quantity of particles may be only partially melted when subjected to the microwave radiation, such that a sintered sublayer is formed surrounding the interior region of the wire and surrounded by the consolidated outermost region. Furthermore, particles within the interior region of the wire may not undergo any significant melting when subjected to the microwave radiation, such that the interior region of the wire essentially remains in powder form.

According to the invention, the powder particles may be formed of one or more metallic and/or nonmetallic materials capable of being heated by microwave radiation, and are sufficiently small to promote their susceptibility to microwave heating. In terms of producing a wire with a solid outermost region (e.g., layer or sheath) enclosing a loose powder material, the process of this invention is considerably less complicated than previous rolling, drawing, and extrusion processes used for this purpose. Furthermore, the process is capable of producing wires that are difficult to fabricate by conventional methods, such as thin weld wires with diameters of about 3.0 mm and less, and weld wires with advanced alloy compositions (for example, alloyed for high oxidation resistance) that cannot be formed by such conventional methods as drawing.

Wires produced by the process of this invention can find use in a variety of applications, including but not limited to feedstock for processes such as thermal spraying, welding, brazing (torch brazing), and PVD processes. For example, wires produced by this invention can be used in coating processes to repair or build up a substrate surface, or to form a thermal, mechanical, and/or environmentally-resistant coating, and in welding and brazing operations to repair and join components.

Other objects and advantages of this invention will be better appreciated from the following detailed description.

DETAILED DESCRIPTION OF THE INVENTION

The invention will be described with specific reference to certain equipment, materials, processes, and processing parameters for producing wire, such as wire suitable for use in depositing coatings to protect, repair, and build up surfaces of components and for use in welding and brazing processes to repair and join components, including components of gas turbine engines. However, the invention has application to a variety of equipment, materials, processes, and processing parameters for producing wire for a variety of other applications other than those discussed, and such variations are within the scope of this invention. In addition, though the following discussion will make reference to the production of wire, this term is intended to include articles that might be described as rods and filaments.

Figure 1:
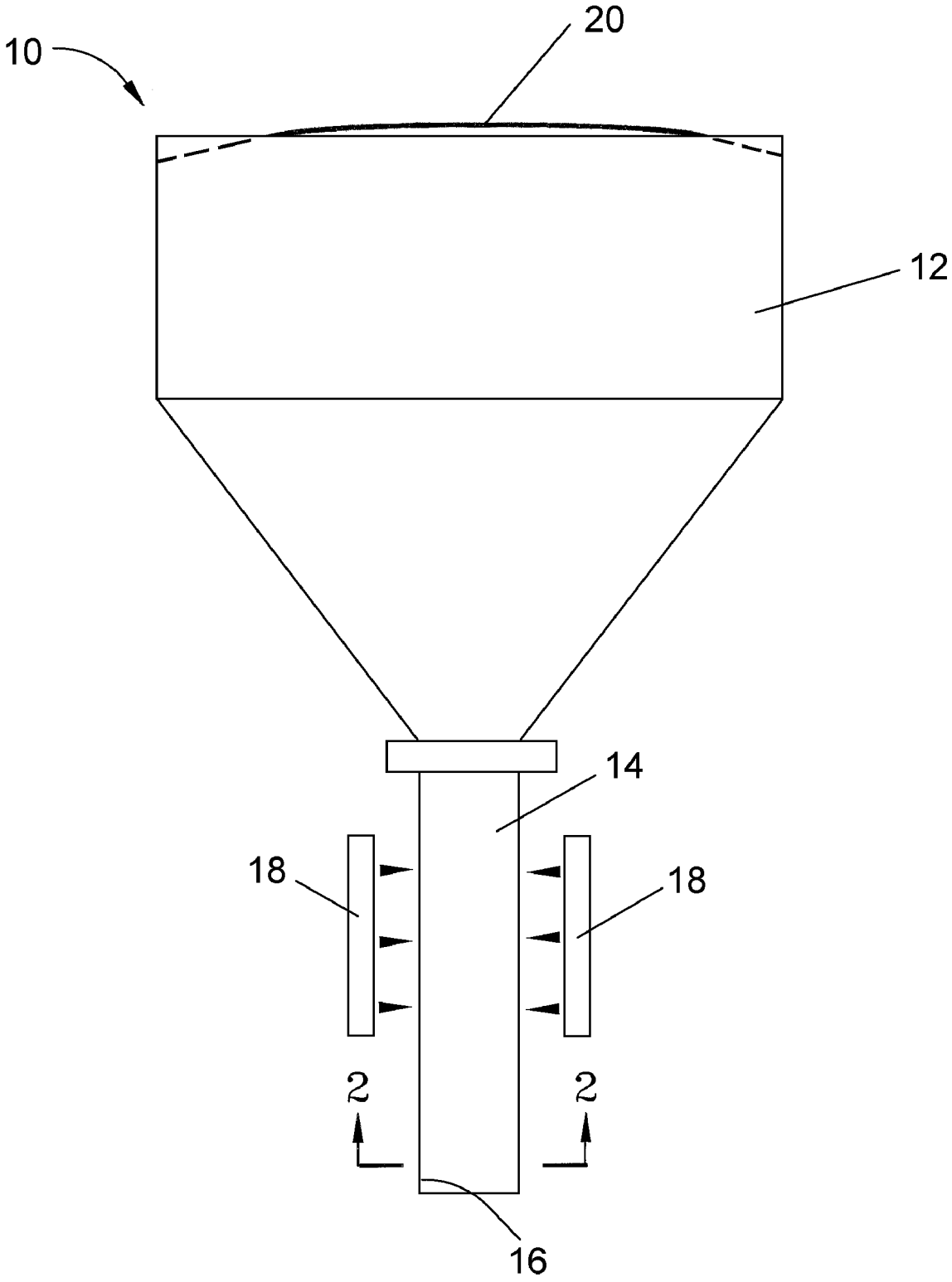
FIG. 1 schematically represents an apparatus for producing wire by microwave heating in accordance with an embodiment of the present invention.
Figure 2:
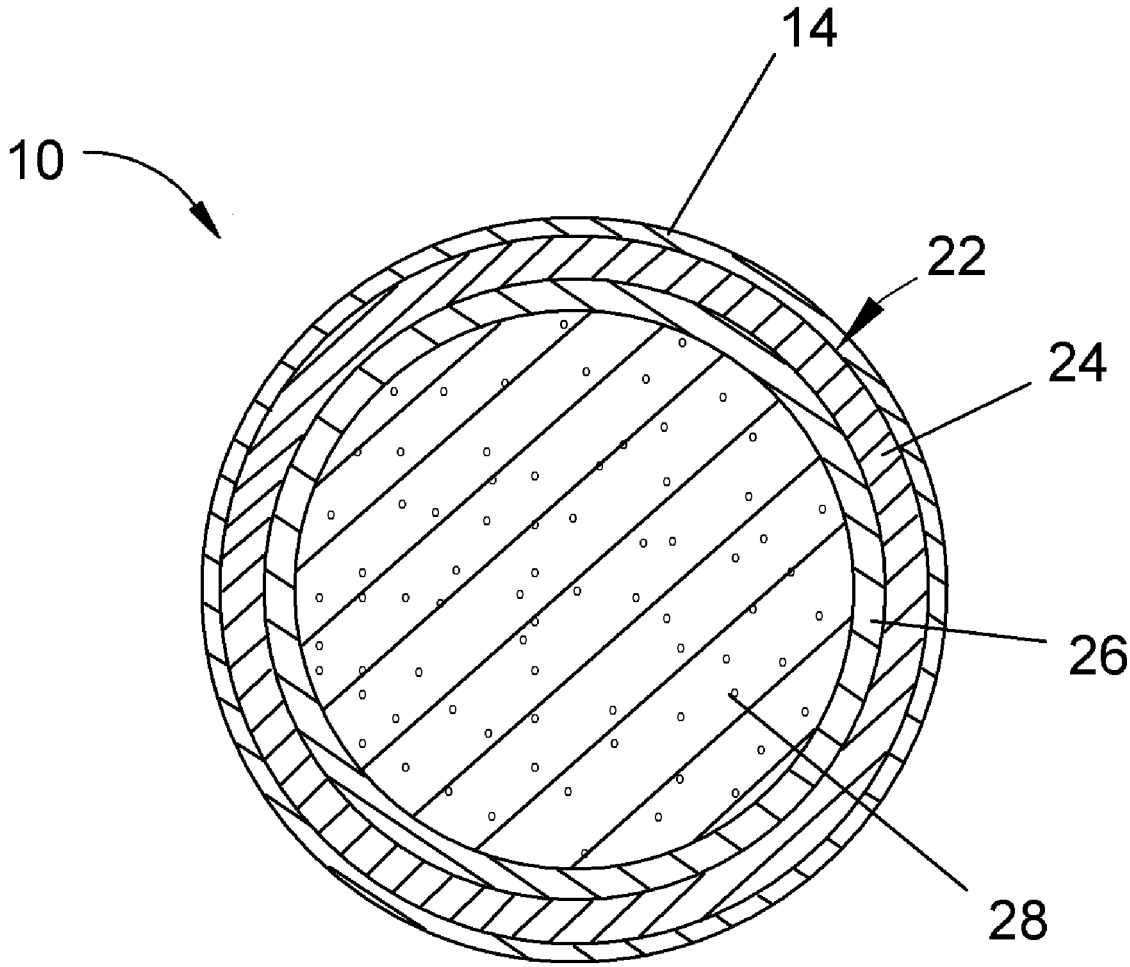
FIG. 2 is a cross-sectional view of a wire in process within the apparatus of FIG. 1.

FIG. 1 schematically represents an apparatus 10 for producing a wire 22 (FIG. 2) in accordance with an embodiment of the present invention. The apparatus 10 is represented as comprising a hopper 12 and feed tube 14 directly below the hopper 12, through which a powder 20 within the hopper 12 passes before exiting at a lower opening 16 of the tube 14. The proportions of the hopper 12 and tube 14 are for illustrative purposes only, and variations in sizes and proportions are within the scope of the invention. The tube 14 is seen in FIG. 2 as having a circular cross-sectional shape to yield a wire 22 having a cylindrical shape, though various other cross-sectional shapes are possible and such shapes are encompassed by the term "tube."

The powder 20 is represented in FIG. 1 as traveling down through the tube 14 solely under the influence of gravity, though it is foreseeable that the flow could be assisted to promote throughput as well as promote compaction of the powder 20 within the tube 14. As the powder 20 flows through the tube 14, the powder particles are subjected to microwave radiation 18, as discussed in more detail below. According to the invention, the powder particles are at least partially melted by the microwave radiation 18 to an extent sufficient to consolidate at least the radially outermost region of the powder 20 within the tube 14 and form the wire 22. The particles can be formed of a variety of materials, limited only by the requirement that the particles have a composition that is suitable for the intended use of the wire 22 and are capable of being heated by microwave radiation 18. With respect to the former, if the wire 22 will be used to deposit a coating or metallurgically join (e.g., weld or braze) components, the powder 20 should be compatible with the material that forms the component (or its surface region) being coated or joined. Compatibility is assured if the particles and component have the very same composition, though suitable compatibility can also be achieved if the particles and component do not have compositions prone to detrimental interdiffusion that would lead to the loss of desired mechanical or environmental properties. As such, the powder particles can be formed of an alloy essentially the same as the component, or an alloy whose base composition is similar to that of the component but modified to contain alloying constituents different from or at different levels than the component in order to achieve, for example, thermal, mechanical, and/or environmental properties superior to that of the substrate. As such, the powder 20 may have a variety of different compositions compatible with substrates formed of various materials, notable examples of which include nickel, cobalt, and iron-base superalloys commonly used for gas turbine engine components, as well as other metals, alloys, intermetallic materials, ceramic materials, and ceramic matrix composite (CMC) materials.

With respect to the requirement that the powder particles are capable of being heated by microwave radiation 18, potential materials include electrical nonconductors (including ceramic materials) and conductors (including metallic and intermetallic materials) under appropriate conditions. According to a preferred aspect of the invention, at least some and preferably all of the powder particles are sufficiently small to be highly susceptible to microwave radiation 18, thereby coupling with the microwave radiation 18 to significantly enhance selective heating and at least partial melting of the particles. For this purpose, it is believed the particles should have a surface area to volume ratio on the order of at least 0.06 $\mu m^2/\mu m^3$, more preferably about 0.14 $\mu m^2/\mu m^3$ or higher. Because microwave radiation has varying electric and magnetic fields, direct electric heating can be significant in certain nonconductive materials, whereas conductive materials are primarily heated through electromagnetic effects. Therefore, depending on the composition of the particles, coupling with the microwave radiation 18 will generally be the result of the particles being sufficiently conductive to generate eddy currents induced by the magnetic field of the microwave radiation 18, and/or possessing a level of electrical resistivity capable of generating joule heating from the eddy currents. It is known that the magnetic loss component of susceptibility for a material in very fine powder size is dependent on factors such as microwave power and frequency. Conversely it is believed that, for a given microwave power and frequency, the interaction between microwave energy and a particular material will be optimum at a distinct particle size for conventional microwave conditions (about 2.45 GHz and about 1 to about 10 kW power). Particle sizes above or below the optimum particle size will not couple as well with microwave radiation. Consequently, suitable and preferred maximum sizes for the particles will depend on the particular application, temperatures, and materials involved. Generally speaking, it is believed that a maximum particle size is on the order of about 140 mesh (about 100 micrometers), more preferably 325 mesh (about 44 micrometers) and smaller. Minimum particle sizes can be as little as nanoscale, e.g., less than 100 nanometers.

In contrast to the particles, bulk materials such as the tube 14 tend to reflect microwave radiation. This aspect of the present invention makes possible the melting of the powder 20 within the tube 14 without melting the tube 14. However, the tube 14 should be sufficiently transparent to the microwave radiation 18 in order to minimize reflection and enable the radiation 18 to penetrate into the powder 20 within the tube 14. A variety of materials are believed to be suitable for use as the material for the tube 14, notable examples of which include inorganic materials such as microwave-transparent ceramics, particularly high purity quartz and alumina.

A wide range of microwave frequencies could be used with the present invention, though in practice regulations will generally encourage or limit implementation of the invention to typically available frequencies, e.g., 2.45 GHz and 915 MHz, with the former believed to be preferred. However, it should be understood that other frequencies are also technically capable of use. A benefit of using a lower frequency is the greater associated wavelength, which may be better suited for higher power transmission or processing of larger components. Suitable microwave power levels will depend on the size and composition of the particles, but are generally believed to be in a range of about 1 to about 10 kW, though lesser and greater power levels are also foreseeable.

The microwave radiation 18 is preferably applied to the powder 20 in a uniform and symmetrical manner capable of passing through the tube 14 and uniformly penetrating into at least the radially outermost regions of the powder 20 within the tube 14. As a nonlimiting example, the microwave radiation 18 can be generated with an applicator chamber of any suitable shape and size. Such a chamber can be formed with a metallic cylinder that surrounds the tube 14, with the top and bottom of the cylinder sealed by metallic plates or honeycomb mesh. For example, the top seal through which the powder 20 flows can be a honeycomb mesh, while the bottom seal can be a metal plate with a hole through which the wire 22 exits the tube 14, with a very tight clearance to choke the microwaves. One or more magnetrons can be used to ensure a uniform field around the tube 14, and the diameter of the applicator chamber can be several decimeters in diameter to promote good mixing of the microwave field (e.g., 30 cm for a 2.45 GHz system).

The particular dimensions and properties of the wire 22 represented in FIG. 2 will depend on the composition of the powder 20 and the intended use of the wire 22. For use as a weld wire, diameters of about 2 mm to about 5 mm are typical, though significantly smaller and greater diameters are also within the scope of the invention. In FIG. 2, the particles within the radially outermost region or layer 24 of the wire 22 were fully melted by the microwave radiation 18, such that on cooling the outermost layer 24 forms a dense and substantially nonporous sheath or shell. In contrast, a sublayer 26 beneath the outermost layer 24 was only partially melted and is therefore a sintered, generally porous region of the wire 22, Finally, the interior 28 of the wire 22, shown as having a larger radial thickness than the layer 24 and sublayer 26 combined, was not melted at all such that the powder particles within the interior 28 are loose but held within the solid sheath formed by the layer 24 and sublayer 26. Depending on the composition and particle size of the powder 20 and the particulars of the microwave radiation 18, the extent that the outermost layer 24 extends into the cross-sectional area of the wire 22 can vary considerably from that represented in FIG. 2, and foreseeably the entire cross-section of the wire 22 could by fully melted by the microwave radiation 18 such that the resulting wire 22 is a homogenous solid. Usage and desired properties of the wire 22 can be optimized by varying the thickness of the outermost layer 24, such that the outermost layer 24 is thicker for wires intended for certain applications and thinner for other applications. To provide structural strength and rigidity to the wire 22, a suitable radial thickness for the outermost layer 24 is believed to be about 10% to about 20% of the radius of the wire 22.

Variations in properties can also be obtained by forming the powder 20 to contain particles of different sizes and/or compositions. For example, two different powders could be simultaneously fed into the tube 14 from separate (e.g., concentric) hoppers, so that the resulting wire 22 has regions with different structures and/or compositions. For example, the outermost layer 24 can be formed of a flux material to permit the wire 22 to be used in certain welding operations. Additionally, the powder 20 can be composed of particles of different compositions and/or size to tailor coupling of the powder 20 with the microwave radiation 18, for example, to promote and/or limit melting of the powder at various locations through the cross-section of the wire 22. As an example, the outermost layer 24 can be formed to contain certain metal oxides (for example, nickel oxide) that readily couple with microwaves to promote the sintering/melting process. If the wire 22 is a weld wire, such oxides can be limited to those that will form a slag on top of the molten metal weld pool that can be easily eliminated from the final weldment. Another example is to formulate the powder 20 to contain one or more materials that are highly susceptible to microwave radiation and, in powder form, will preferentially couple with the microwave radiation 18. For example, a high-susceptibility material can be provided in the form of separate particles mixed into the powder 20, or can be alloyed with the individual powder particles. Depending on the composition of the powder 20 and the intended use of the wire 22, suitable high-susceptibility materials can be chosen on the basis of their ability to dissolve into the composition of the particles when molten without creating inhomogeneities in the wire 22 or a weldment, brazement, etc., produced with the wire 22. In view of the foregoing, potentially suitable high-susceptibility materials are believed to include, but are not limited to, silicon, germanium, gallium, cobalt, iron, zinc, titanium, carbon (e.g., carbon nano-tubes or fine graphite powder), aluminum, tantalum, niobium, rhenium, hafnium, molybdenum, nickel oxide, and silicon carbide.

While the invention has been described in terms of particular embodiments, it is apparent that other forms could be adopted by one skilled in the art. Accordingly, the scope of the invention is to be limited only by the following claims.

The invention claimed is:

1. A process for producing a wire from powder particles, the process comprising:

consolidating a loose powder within a passage by subjecting the loose powder to microwave radiation while particles of the loose powder are not bonded to each other and as the loose powder flows through the passage, the loose powder consisting of particles formed of metallic, intermetallic and/or ceramic materials and of a size and composition that render the particles susceptible to microwave radiation, the loose powder within the passage being subjected to microwave radiation so that the particles thereof couple with the microwave radiation and are sufficiently heated to melt at least a radially outermost quantity of the particles within the passage, wherein the passage is formed of a material substantially transparent to microwave radiation and the microwave radiation passes through the passage before heating the particles within the passage; and then cooling the particles so that the radially outermost quantity of the particles solidifies to yield a wire comprising a consolidated outermost region surrounding an interior region of the wire.

2. The process according to claim 1, wherein the radially outermost quantity of the particles are fully molten during the subjecting step and the outermost region is substantially non-porous following the cooling step.

3. The process according to claim 1, wherein the interior region of the wire is defined by an interior quantity of the particles surrounded by the radially outermost quantity of the particles, and the interior quantity of the particles is not melted during the subjecting step such that the interior region of the wire remains in powder form following the cooling step.

4. The process according to claim 3, wherein the interior region of the wire has a radially thickness greater than the radial thickness of the outermost region.

5. The process according to claim 1, wherein a second quantity of the particles that is radially inward from the radially outermost quantity of the particles is partially melted during the subjecting step, and the second quantity of the particles solidifies during the cooling step to form a sintered sublayer surrounding the interior region and surrounded by the outermost region.

6. The process according to claim 5, wherein the interior region of the wire is defined by an interior quantity of the particles surrounded by the sublayer, and the interior quantity of the particles is not melted during the subjecting step such that the interior region of the wire remains in powder form following the cooling step.

7. The process according to claim 6, wherein the interior region of the wire has a radially thickness greater than the combined radial thicknesses of the outermost region and the sintered sublayer.

8. The process according to claim 1, wherein the particles are formed of at least one metallic material.

9. The process according to claim 1, wherein the particles are formed of at least one ceramic material.

10. The process according to claim 1, wherein the particles are formed of a single metallic material.

11. The process according to claim 1, wherein the particles have a maximum particle size of about 100 micrometers.

12. A process for producing a metallic wire from metallic powder particles, the process comprising:

shaping and consolidating a loose powder within a tubular member by subjecting the loose powder to microwave radiation while particles of the loose powder are not bonded to each other and as the loose powder flows through the tubular member, the loose powder consisting of metallic particles, the tubular member being substantially transparent to microwave radiation, the loose powder within the tubular member being subjected to microwave radiation so that the particles thereof couple with the microwave radiation and are sufficiently heated to melt a radially outermost quantity of the particles within the tubular member and partially melt a second quantity of the particles that is radially inward from the radially outermost quantity of the particles; and then cooling the particles so that the second and radially outermost quantities of the particles solidify to yield a metallic wire comprising a sintered sublayer surrounding an interior quantity of the particles and an outermost shell surrounding the sintered sublayer.

13. The process according to claim 12, wherein the radially outermost quantity of the particles are fully molten during the subjecting step and the outermost shell is substantially nonporous following the cooling step.

14. The process according to claim 12, wherein the outermost shell has a radial thickness of about 10% to about 20% of the radius of the wire.

15. The process according to claim 12, wherein the interior quantity of the particles is not melted during the subjecting step and is in powder form following the cooling step.

16. The process according to claim 12, wherein the particles are formed of at least one metallic material.

17. The process according to claim 12, wherein the particles are formed of a single metallic material.

18. The process according to claim 12, wherein the particles have a maximum particle size of about 44 micrometers.

* * * * *